United States Patent [19]

Schroeder

[11] 4,378,825

[45] Apr. 5, 1983

[54] LOG SPLITTER

[76] Inventor: Edward M. Schroeder, R.R. Box 158, Chapin, Ill. 62628

[21] Appl. No.: 213,305

[22] Filed: Dec. 5, 1980

[51] Int. Cl.[3] ..... B27L 7/00

[52] U.S. Cl. ..... 144/193 R

[58] Field of Search ..... 144/193 R

[56] References Cited

U.S. PATENT DOCUMENTS

| | | | |
|---|---|---|---|
| 168,649 | 10/1875 | Latus | 144/193 C |
| 846,838 | 3/1907 | Fannon | 144/193 A |
| 1,304,528 | 5/1919 | Anderson | 144/193 R |
| 3,242,955 | 3/1966 | Hellstrom | 144/193 A |
| 3,640,323 | 2/1972 | Helle | 144/193 A |
| 4,066,110 | 1/1978 | Sarno | 144/193 A |
| 4,076,062 | 2/1978 | Kanik | 144/193 A |
| 4,116,251 | 9/1978 | Graney | 144/193 R |
| 4,133,359 | 1/1979 | Jensen et al. | 144/193 R |
| 4,141,396 | 2/1979 | McCallister | 144/193 A |
| 4,222,419 | 9/1980 | Oliver | 144/193 R |

*Primary Examiner*—W. D. Bray

*Attorney, Agent, or Firm*—Keil & Witherspoon

[57] ABSTRACT

There is claimed a log splitter comprising means for penetrating a log, a handle pivotally mounted for manual operation, a cam shaped sheave which is rotated by rotation of the handle, a ratchet and pawl assembly which transmits force from the handle to the sheave, a drive cable attached so that it is wound onto said sheave, and as said drive cable is wound onto the sheave it causes a sharpened edge to penetrate the log, splitting the log, and the cam shape of the sheave produces large mechanical advantage as the log is initially penetrated, and lesser mechanical advantage but greater travel distance as the penetration continues.

18 Claims, 16 Drawing Figures

LOG SPLITTER

BACKGROUND OF THE INVENTION

This invention relates generally to manually operated devices for splitting logs. This invention is particularly adaptable to the manual splitting of logs for use in a fireplace, a wood burning stove, or the like.

A particularly novel and useful feature of the device is a cam shaped sheave that winds up a drive cable and thereby draws a log penetrating wedge into the log. The cam shape allows a high mechanical advantage as the log is first penetrated, and a progressively lower mechanical advantage but greater travel distance of the wedge as the log is further split.

A further novel feature of the present invention is a manually operated handle which operates a ratchet and pawl assembly. The ratchet rotates the sheave and draws the wedge into the log.

Manually operated log splitters of the prior art have employed direct gearing to transmit rotation of a handle into penetration of the log. A major disadvantage of the prior art is that downward force on the handle causes upward rotation of the frame of the log splitter. A further disadvantage of the prior art is that the force on the log is not greatest just as penetration of the log begins. In contrast, motion is reversed by the drive cable of the present invention, and downward force on the handle causes the log splitter to remain stationary.

Other prior art manual log splitters employ a complex arrangement of pulleys and levers, and attempt to split the log along its long dimension.

In contrast, the present invention is a compact device which is easy to use. Fireplace logs can be easily split by a small person of weight 110 pounds or less by his/her simply operating the handle. The large mechanical advantage produced by the cam shaped sheave makes splitting of logs very easy with the present invention.

SUMMARY OF THE INVENTION

There is claimed a log splitter comprising:

means for penetrating a log;

means for holding said log against the force exerted upon said log by said means for penetrating said log;

a handle pivotally mounted at a first end and manually moved in an arcuate path at a second end;

a drive cable attached at a first end so as to provide said force between said means for penetrating said log and said means for holding said log;

a sheave rotatably mounted for the purpose of having said drive cable wound about its exterior surface;

means for winding a second end of said drive cable onto said exterior surface of said sheave by said arcuate motion of said handle;

a frame which supports the parts of said log splitter;

whereby arcuate motion of said handle rotates said sheave causing said drive cable to wind about the exterior surface of said sheave and said winding causes the distance between said means for penetrating said log and said means for holding said log to decrease, thereby exerting compressive force upon said log and causing said means for penetrating said log to penetrate said log and split said log.

DETAILED DESCRIPTION OF THE PREFERRED EMBODIMENT

Figure 1:
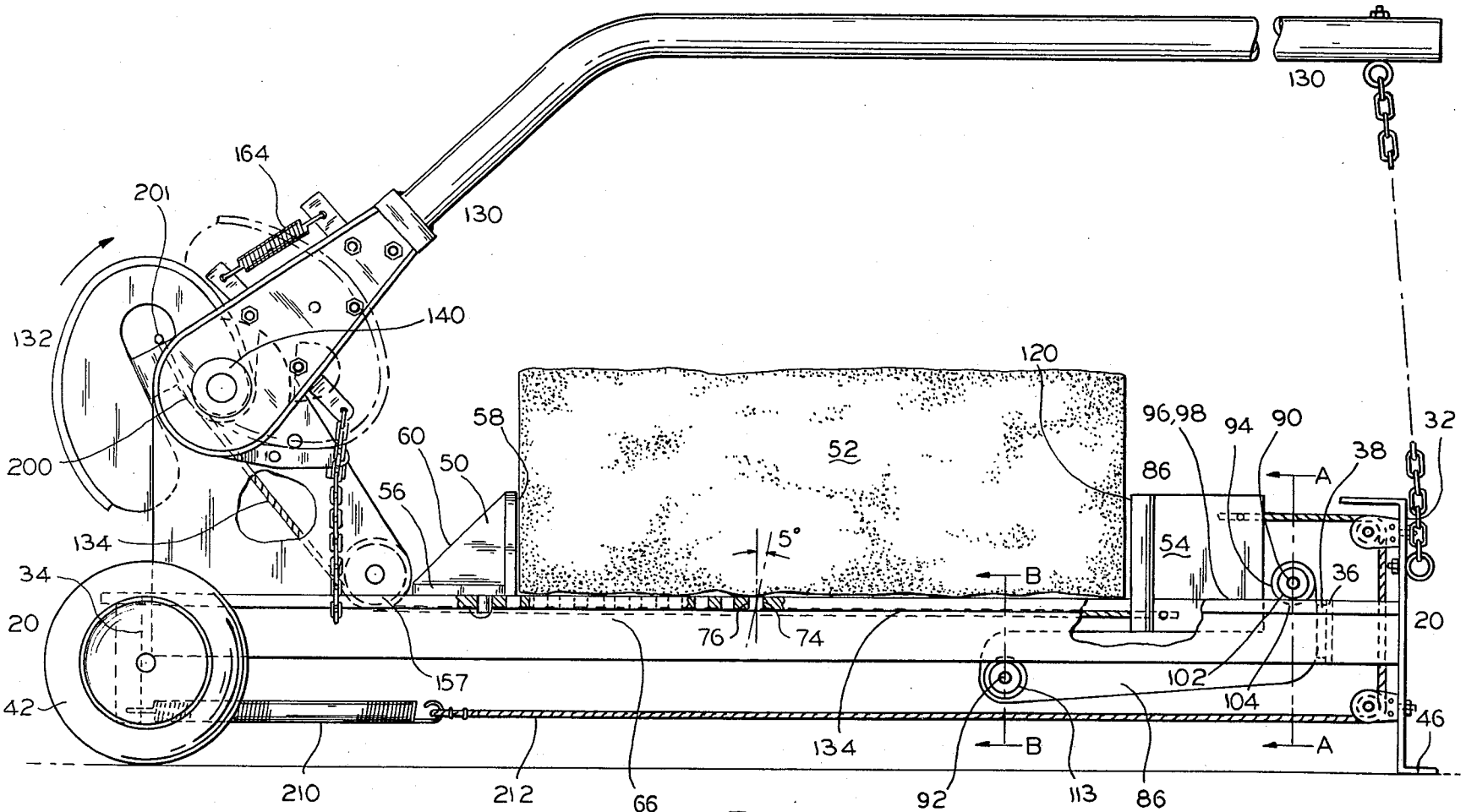
FIG. 1 is a left side view of the log splitter.
Figure 8:
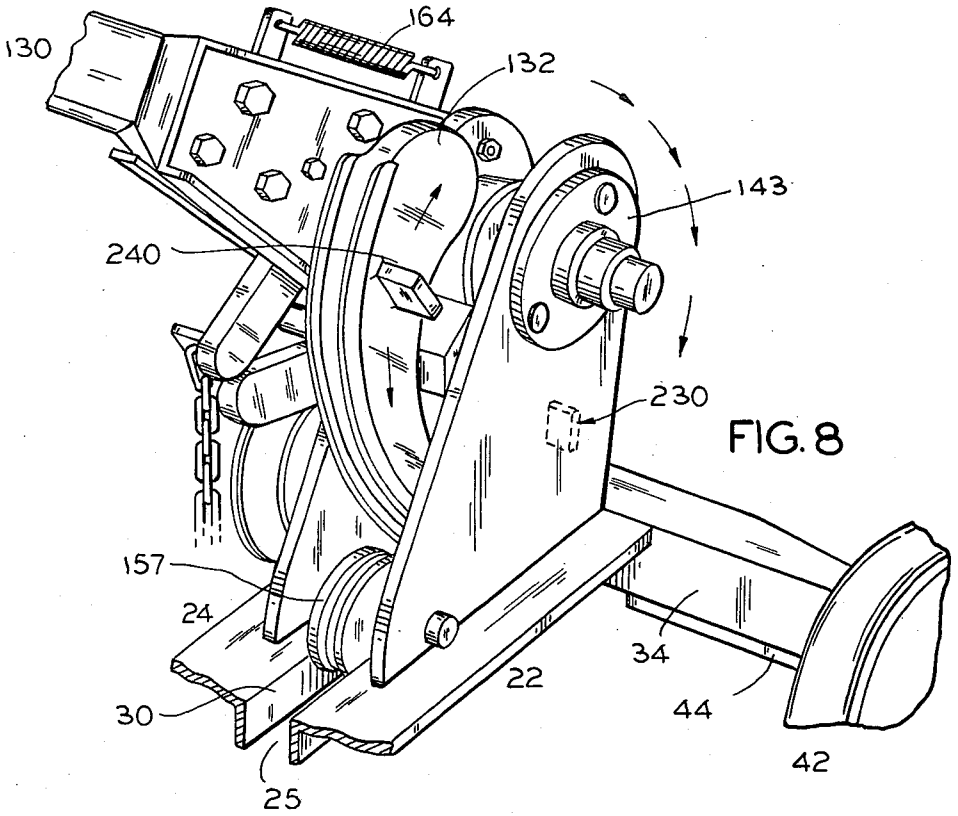
FIG. 8 is a detail view of the rear of the frame.
Figure 7:
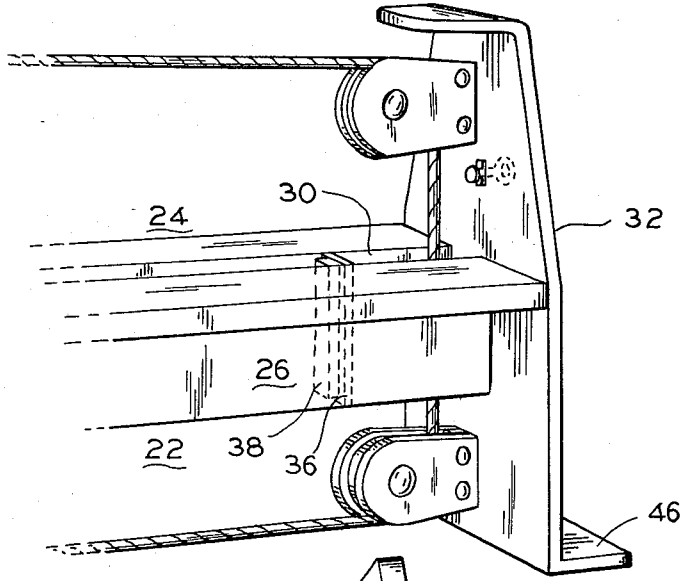
FIG. 7 is a detail view of the front of the frame.
Figure 6:
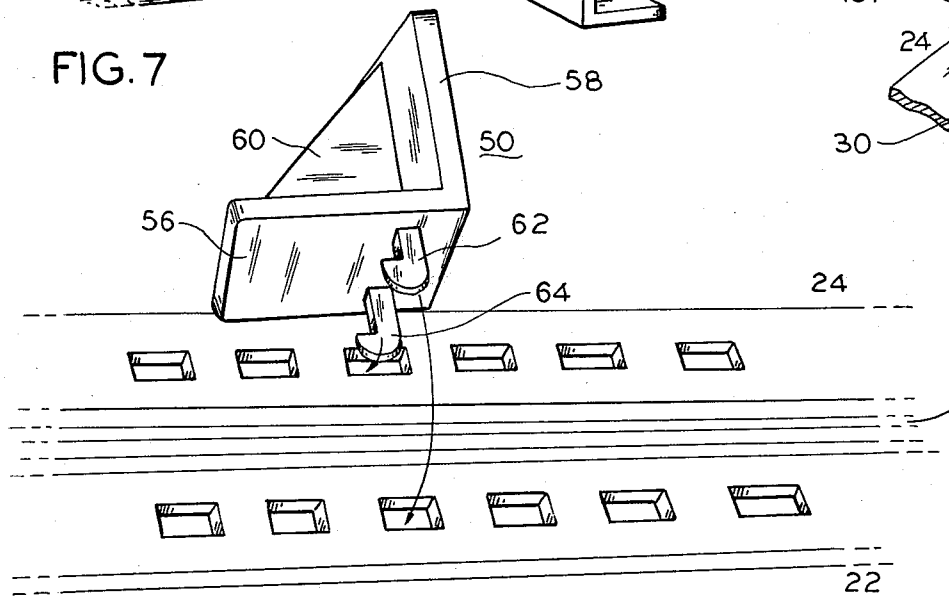
FIG. 6 is a perspective view of the backstop and the positioning holes, viewed from above.
Figure 12A:
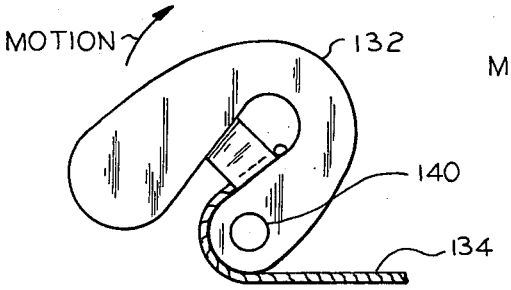
FIG. 12 is a side view showing alternate sheaves at FIGS. 12A and 12B.
Figure 12B:
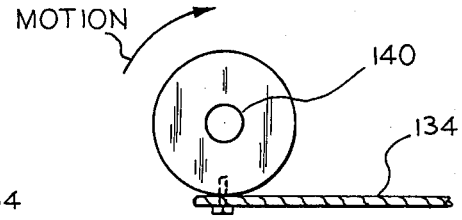

An embodiment of the invention which has been found to perform well is herein described. Referring to FIG. 1, a side view of the log splitter is shown. A frame 20 is welded from angle iron and steel plate. Two long members 22 and 24 are formed from angle iron of approximate dimension $2\frac{1}{2}$ inches$\times 2\frac{1}{2}$ inches$\times\frac{1}{2}$ inch and are approximately 48 inches long. Referring to FIG. 7 and FIG. 8, members 22 and 24 each have two sides of material joined at essentially right angles. A first side 26 of the first member 22 is spaced apart from and essentially parallel to a first side 30 of the second member 24. Side 26 of the first member 22 is spaced approximately 1-1/16 inch from side 20 of the second member 24. A rectangularly shaped space 25 is formed between sides 26 and 30.

Both member 22 and member 24 are joined, as by welding, to a front frame plate 32. Front frame plate 32 may be made of $\frac{1}{4}$ inch steel plate. Also both member 22 and member 24 are joined, as by welding, to a rear frame plate 34. Rear frame plate 34 may be made of angle iron of dimension $2\frac{1}{2}\times 2\frac{1}{2}\times\frac{1}{2}$ inches. Secure joinder, as by welding, of members 22 and 24 to front frame plate 32 and to rear frame plate 34 maintain the spacing of sides 26 and 30 so that they maintain their essentially parallel orientation. A bumper plate 36 made of approximately $\frac{1}{4}$ inch steel plate, is attached, as by welding, between sides 26 and 30. A resilient material 38 such as rubber is attached to bumper plate 36. Wheels 42 are rotatably attached to an axel 44, and axel 44 is attached to rear frame plate 34. A bent projection 46 of front frame plate 32 serves as a front support for the frame 20.

A backstop 50 holds a log 52 against force exerted upon the log 52 by the wedge 54. Backstop 50 is formed out of approximately $\frac{1}{2}$ inch steel plate. Backstop 50 has two surfaces, a bottom 56 and a back 58, and also a brace 60. Two claws 62 and 64 extend below bottom 56 of backstop 50 and lock into holes 66. Holes 66 are cut in horizontal side 70 of first frame member 22 and horizontal side 72 of second frame member 24. Holes 66 are essentially rectangular in shape. Holes 66 are cut with essentially parallel sides. The front side 74 of hole 66 and the back side 76 of hole 66 are at an angle of approximately 5 degrees to the vertical. Making holes 66 approximately 5 degrees off vertical improves the stability of backstop 50 when force is brought against back 58 by log 52.

Holes 66 are located in pairs so that backstop 50 can be located to accommodate logs 52 of different lengths. The plane of back 58 of backstop 50 is essentially perpendicular to the long dimension of frame members 22 and 24. The force exerted against back 58 by log 52 will be approximately equally distributed between the two claws 62 and 64 of backstop 50.

Figure 10:
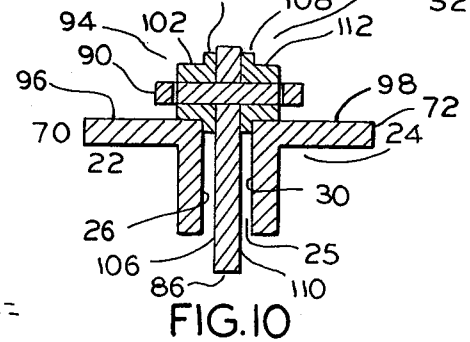
FIG. 10 is a sectional view through section A—A.
Figure 11:
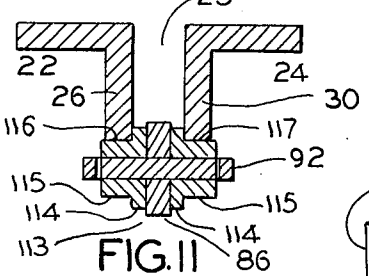
FIG. 11 is a sectional view through section B—B.
Figure 5:
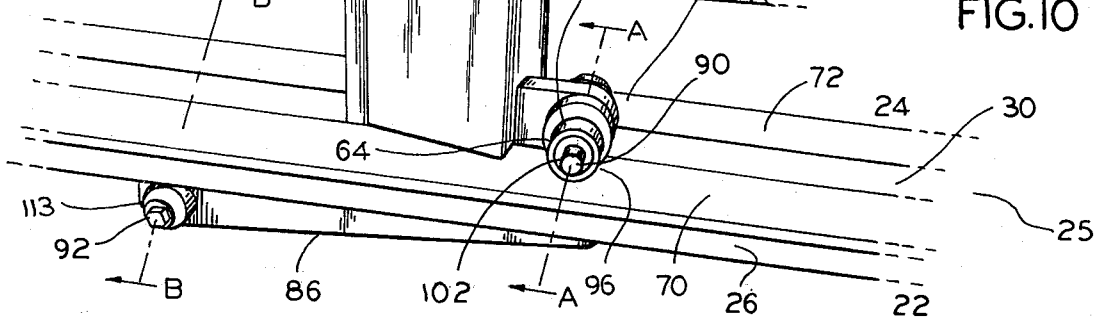
FIG. 5 is a right perspective view of the log penetrating wedge, viewed from above.
Figure 9:
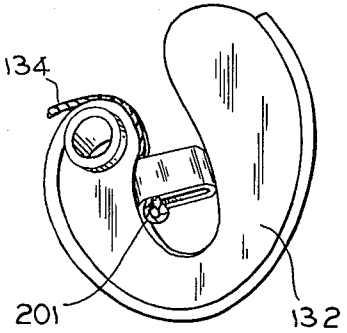
FIG. 9 is a perspective of the sheave with drive cable attached.

The wedge carriage 86 is made of essentially ½ inch steel plate. Referring to FIGS. 5, 7, 10 and 11, there are two axles 90 and 92 fixedly mounted to wedge carriage 86. Axle 90 is mounted above the horizontal sides 70 and 72 of frame members 22 and 24. Wheels 94 are rotatably mounted on axle 90. Wheels 94 roll along upper surfaces 96 and 98 of sides 70 and 72. Wheels 94 are made in the form of two cylinders. The outer cylinder 102 is of smaller diameter than the inner larger cylinder 104. Referring to FIG. 10, the larger diameter cylinder 104 serves as a spacer between the first side 26 of frame 22 and the adjacent side 106 of wedge carriage 86. Likewise the larger diameter cylinder 108 serves as a spacer between surface 30 of frame member 24 and the corresponding surface 110 of the wedge carriage 86. The smaller diameter cylinder 102 and 112 serve as wheel surfaces by rolling along the horizontal surfaces 70 and 72 of frame members 22 and 24.

Wheels 113 are likewise made of two cylinders, with an inner large diameter cylinder 114 and smaller outer diameter cylinder 115. The large diameter cylinders maintain spacing of the wedge carriage 86 within space 25, and the small diameter cylinders serve as wheels and roll along the bottom surfaces 116 and 117 of members 22 and 24. The wedge carriage 86 is maintained essentially centered in the space 25.

The wedge blade 119 may be made out of ½ inch thick high carbon steel, with a sharpened, hardened edge 120. A triangular shroud 122 is attached, as by welding, with its apex affixed to the wedge blade 119 slightly to the rear of the hardened edge 120. The hardened edge 120 penetrates the log 52 which is to be split, and upon entering into the wood, the triangular shroud 122 facilitates further splitting of the wood.

Figure 2:
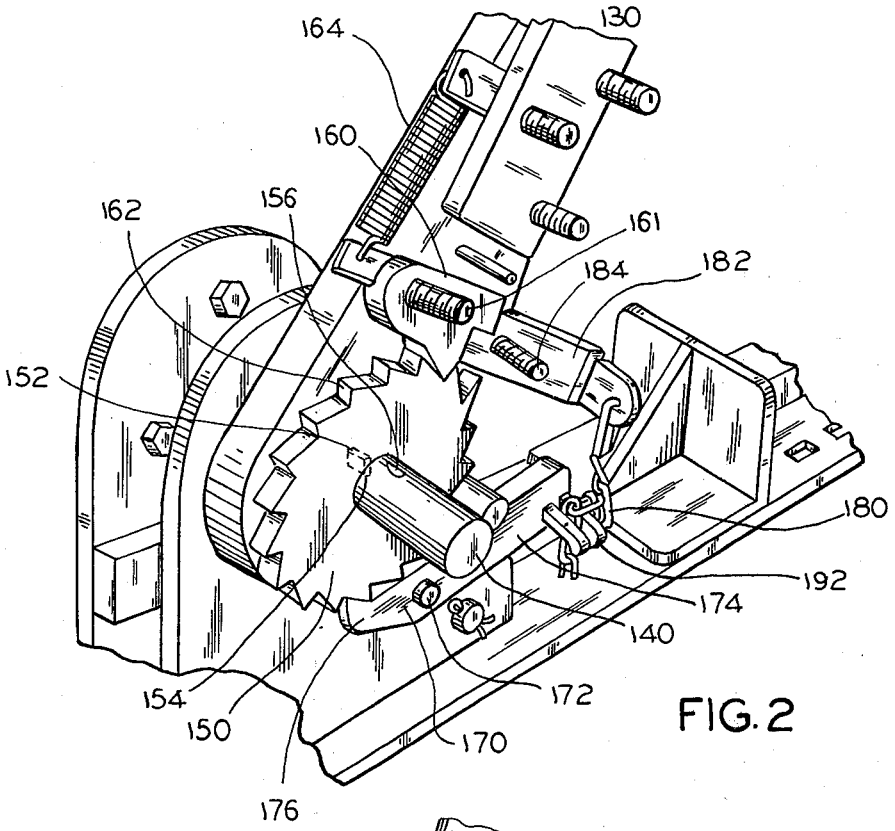
FIG. 2 is a left perspective view of the ratchet and pawl, viewed from above.
Figure 3:
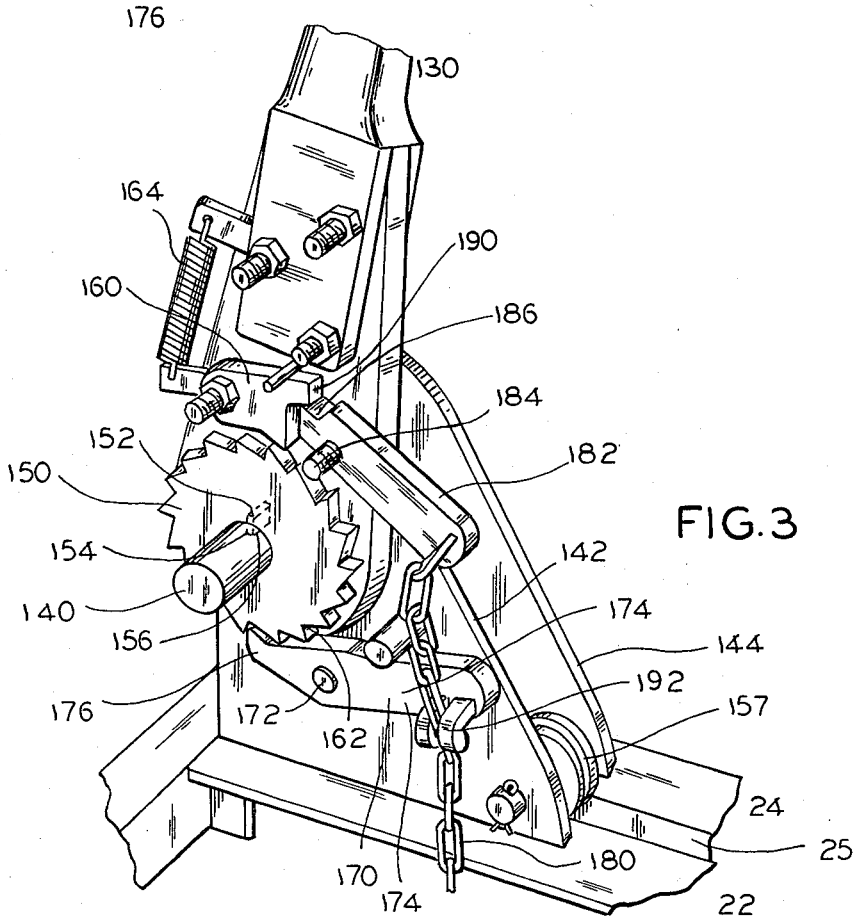
FIG. 3 is a right perspective view of the ratchet and pawl, viewed from above.
Figure 4:
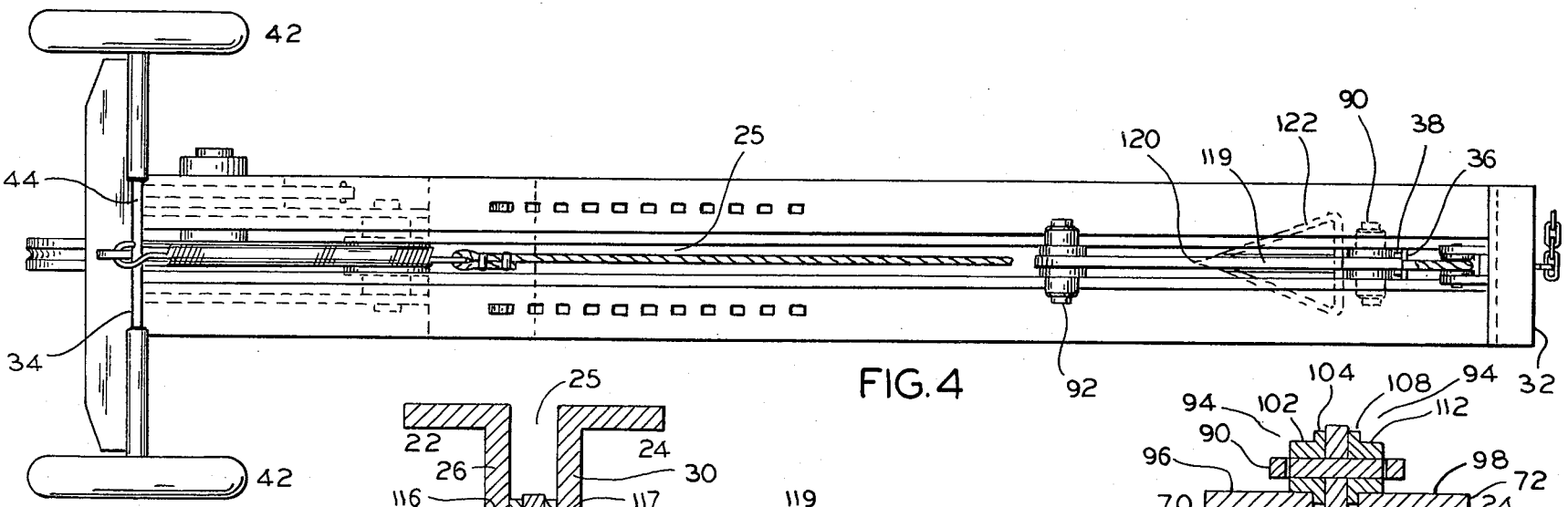
FIG. 4 is a bottom view of the log splitter.

A handle 130 is used to rotate a sheave 132. As sheave 132 rotates, it winds up a cable 134, one end of which is fixedly attached to the sheave 132. The other end of the cable 134 is fixedly attached to the wedge carriage 86. As the cable 134 winds up on sheave 132, the hardened edge 120 of the wedge blade 119 is drawn by cable 134 against log 52 with sufficient force to penetrate and split log 52. Either a ⅜ inch diameter steel stranded cable or a leaf chain of the type sold by Morse Chain Div. of Borg Warner Corporation of average ultimate strength of 18,000 pounds or more has proven satisfactory as cable 134. Cable 134 is wound onto sheave 132 by rotation of handle 130. The handle 130 is rotatably mounted on drive shaft 140. Referring to FIGS. 1, 2 and 3, drive shaft 140 is rotatably mounted in the first bearing support plate 142 and the second bearing support plate 144. The first bearing support plate 142 is fixedly attached, as by welding, to first frame member 22. The second bearing support plate 144 is fixedly attached, as by welding, to second frame member 24. The two bearing support plates 142 and 144 are mounted essentially parallel. The two bearing support plates 142 and 144 may be fixedly attached, as by welding, to an end plate (not shown). The bearing support plates 142 and 144 may be made of approximately ½ inch thick steel plate. The drive shaft 140 is rotatably mounted between the two bearing support plates 142,144. The axis of drive shaft 140 is essentially perpendicular to the long dimension of the frame 20. Drive shaft 140 has been found to be satisfactory when made of approximately 1¼ inch diameter steel shaft. Drive shaft 140 is mounted in bearings 143. Bearings 143 are mounted in bearing support plates 142 and 144.

A ratchet wheel 150 is fixedly mounted on drive shaft 140, as by use of a key and channel mounting. Referring to FIG. 2, Channel 152 is cut in ratchet wheel 150, and Channel 154 is cut in drive shaft 140, and a Key 156 lockingly holds ratchet wheel 150 onto drive shaft 140. Alternatively it has been found satisfactory to weld ratchet wheel 150 to drive shaft 140. Inertial welding wherein heat generated by friction from spinning shaft 140 within ratchet wheel 150 may be used to accomplish this weld. The sheave 132 is fixedly mounted on drive shaft 140, as by use of key and channel mounting (not shown). The sheave 132 is mounted between the two bearing support plates 142 and 144, and additionally the sheave is essentially centered above the space 25. An idler pulley 157 is rotatably mounted between bearing support plates 142 and 144, and essentially centered over space 25. Idler pulley 157 guides cable 134 between sheave 132 and wedge carriage 86.

Rotation of handle 130 is transmitted to the drive shaft 140 by means of drive pawl 160. Drive pawl 160 is rotatably mounted on axle 161. Axle 161 is fixedly mounted to handle 130. Drive pawl 160 bears against the teeth 162 of ratchet wheel 150 as handle 130 is moved in a downward direction. Drive pawl 160 causes ratchet wheel 150 to rotate, the rotation of ratchet wheel 150 is transmitted to drive shaft 140, and the rotation of drive shaft 140 in turn causes sheave 132 to rotate. Upward motion of handle 130 causes drive pawl 160 to slidably move around ratchet wheel 150. Spring 164 keeps drive pawl 160 in contact with ratchet wheel 150.

Figure 15:
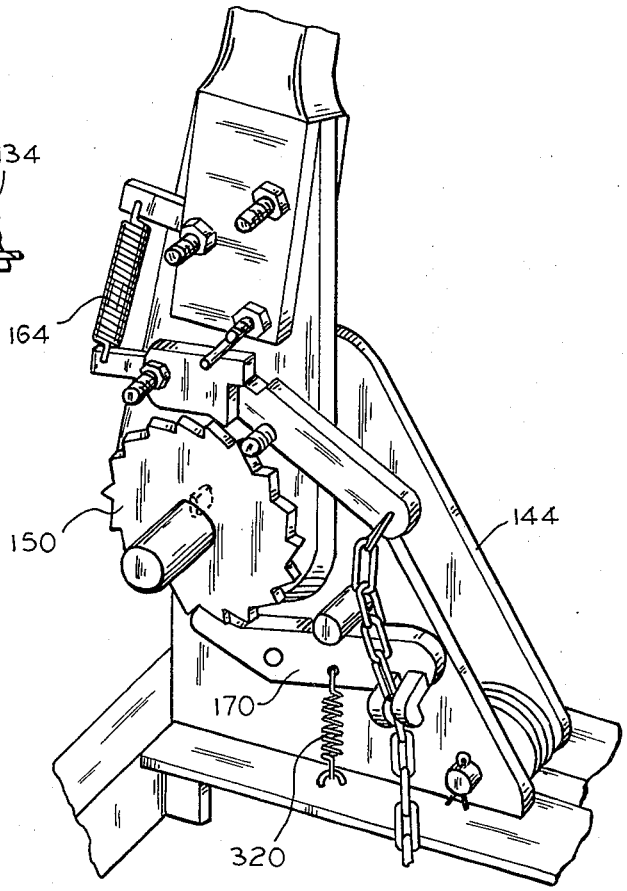
FIG. 15 is a right perspective view of the ratchet and pawl, received from above.

Holding pawl 170 is rotatably mounted on axle 172. Axle 172 is fixedly attached to bearing support plate 142. A spring 320 may be used to hold holding pawl 170 in contact with the teeth 162 of ratchet wheel 150 as shown in FIG. 15. An alternative means of maintaining contact between holding pawl 170 and ratchet wheel 150 is to make the far end 174 of holding pawl 170 heavier than the near end 176 so that the force of gravity causes the near end 176 to rotate upwardly and to engage the teeth 162 of ratchet wheel 160. Holding pawl 170 prevents the ratchet wheel 150 from rotating backwards and allowing the cable 134 to unwind from sheave 132. Holding pawl 170 may be provided with a foot pedal (not shown) to provide a convenient means for the operator to release holding pawl 170 from ratchet wheel 150, thereby allowing sheave 132 to rotate backwards and the cable 134 to unwind from sheave 132. Alternatively a trip chain 180 may be used to release holding pawl 170. Holding chain 180 is fixedly attached to trip lever 182. Trip lever 182 is rotatably mounted on axle 184. Axle 184 is fixedly attached to handle 130. Trip chain 180 is attached at one end to trip lever 182 and at the other end to holding pawl 170. When handle 130 is rotated into an extreme upward position, trip chain 180 causes rotation of both holding pawl 170 and trip lever 182. The rotation of holding pawl 170 releases holding pawl 170 from the ratchet wheel 150. The rotation of trip lever 182 causes its surface 186 to contact surface 190 of drive pawl 160, thereby causing rotation of drive pawl 160 and consequently releasing ratchet wheel 150, so that ratchet wheel 150 is free to turn backwards and the cable 134 may then unwind from sheave 132. Other methods of conveniently releasing drive pawl 160 and holding pawl 170 so that the sheave 132 may turn backwards and cable 134 may then unwind from sheave 132 will be obvious to a person skilled in the art. The angle to which the handle 130 must be raised in order to release ratchet wheel 150 may be adjusted by adjusting the link of trip chain 180 which is held in fingers 192 of holding pawl 170.

Cable 134 is wound upon sheave 132 by downward motion of handle 130, and the force causing rotation of sheave 132 is transmitted by drive pawl 160 from handle 130 to ratchet wheel 150. The rotation of ratchet wheel 150 is transmitted to sheave 132 by rotation of drive shaft 140. Cable 134 draws the wedge carriage 86 toward log 52 as cable 134 is wound onto sheave 132. Cable 134 is guided by idler pulley 157. As wedge carriage 86 begins its motion, the edge 120 of the wedge 119 is drawn into contact with log 52, and begins penetration of log 52. At the beginning of penetration of log 52, the wedge carriage is ideally positioned against bumper 36, and the cable 134 is fully unwound from sheave 132.

Referring to FIG. 1, the cable 134 is shown in the fully unwound configuration. Log 52 is placed in position for splitting, and backstop 50 is positioned to hold log 52 against the force of edge 120. In the position shown in FIG. 1, the handle provides a long lever arm for application of force by the operator, and the distance from the center of drive shaft 140 to the cable at location 200 provides the lever arm for application of force to the edge 120 against log 52. As rotation of sheave 132 initially begins, the distance from the center of drive shaft 140 to location 200 is approximately one inch. The end of handle 130 is approximately 5 feet 6 inches from the center of drive shaft 140, or a distance of approximately 66 inches. The theoretical mechanical advantage is therefore approximately 66 to 1. If approximately 100 pounds of force are applied to the end of handle 130, then approximately 6,600 pounds, or 3.3 tons of force will be applied to log 52 along edge 120, with some subtractions to account for friction within the device. As the cable winds upon sheave 132, the distance between the center of drive shaft 140 and location 200 increases because of the cam shape of sheave 132, and the mechanical advantage therefore decreases. It is convenient to have the mechanical advantage decrease as the log 52 is further penetrated because the force required to continue splitting a log is much less than the force required to initially split the log. And as the mechanical advantage decreases, the distance of travel of wedge carriage 86 increases, for a given angular rotation of handle 130. It is convenient to decrease the mechanical advantage as the log is split in order to reduce the amount of motion of the handle which is needed to complete motion of edge 120 into the log for completion of splitting of the log. Cable 134 is fixedly attached to sheave 132 at location 201.

Figure 14:
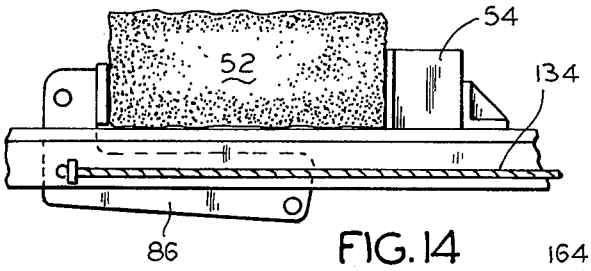
FIG. 14 is a side view of the carriage.

A return spring 210 and a return cable 212 apply force to the wedge carriage 86 to return it against backstop 36. When the drive pawl 160 and the holding pawl 182 are released to permit backward rotation of ratchet wheel 150, then return spring 210 through return cable 212 pulls the wedge carriage 86 into position against backstop 36, and unwinds the cable 134 from sheave 132. Alternatively a compression spring 300 may be used to return wedge carriage 86 to position against backstop 36, as shown in FIG. 14. Referring to FIG. 8, a fixed stop 230 and a sheave mounted stop 240 serve to limit the rotational motion of sheave 132.

Figure 16A:
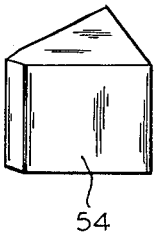
FIG. 16 shows alternate forms for the wedge at FIGS. 16A and 16B.
Figure 16B:
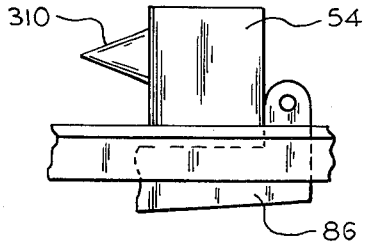

Alternatively the wedge which penetrates the log may be fixedly mounted upon the frame, and the movable carriage then bears against the log by means of a flat plate and drives the log onto the wedge, as shown in FIG. 14. Alternatively the wedge may be replaced by a cone-shaped penetrating element 310 with a sharpened hardened point which penetrates the log, as shown in FIG. 16B. Other shaped penetrating elements may be substituted for the wedge.

The foregoing description of the invention has been directed to a preferred embodiment in accordance with the requirements of the Patent Act, for the purpose of explaining the invention and not for the purpose of limiting the scope and spirit of what has been disclosed herein. It will be apparent to persons skilled in the art that modifications may be made in the device disclosed herein to suit the device to different materials. The claims appended hereto are intended to set forth the true scope and spirit of the invention, including but not being limited to the particular embodiments disclosed hereinabove.

What is claimed is:

1. A log splitter comprising:

(a) a frame which supports the parts of said log splitter;

(b) means for penetrating a log which exerts force against said log;

(c) means for holding said log against the force exerted upon said log by said means for penetrating said log;

(d) a handle pivotally mounted at a first end to said frame and manually moved in an arcuate path at a second end;

(e) a sheave rotatably mounted on said frame and driven in rotational motion by said handle when said handle is manually moved in said arcuate path;

(f) a drive cable attached at a first end to said sheave so that said drive cable is wound onto said sheave as said sheave is driven in said rotational motion, thereby providing said force between means for penetrating said log and said means for holding said log;

whereby arcuate motion of said handle rotates said sheave causing said drive cable to wind about the exterior surface of said sheave and said winding causes the distance between said means for penetrating said log and said means for holding said log to decrease, thereby exerting compressive force upon said log and causing said means for penetrating said log to penetrate said log and split said log.

2. A log splitter as claimed in claim 1, wherein said means for penetrating a log comprises a movable wedge which is attached to a second end of said drive cable.

3. A log splitter as claimed in claim 1, wherein said means for holding said log comprises a fixed backstop which may be mounted at one of several fixed positions.

4. A log splitter as claimed in claim 1, wherein said means for holding said log comprises a fixedly mounted backstop.

5. A log splitter as claimed in claim 1, wherein the external surface of said sheave comprises a cylindrical surface.

6. A log splitter as claimed in claim 1, wherein said sheave comprises a cam having an eccentric axis of rotation and a grooved, curvate peripheral edge having progressively increasing distances between progressive points along said edge and the axis of rotation, whereby said edge is said exterior surface upon which said drive cable is wound for the purpose of providing a large mechanical advantage and consequently large force as said means for penetrating said log initially penetrates said log, and thereafter delivers lesser force but greater linear travel distance as said means for penetrating said log penetrates and continues to split said log.

7. A log splitter as claimed in claim 1, wherein said means for winding a second end of said drive cable onto said sheave comprises:

(a) a drive shaft rotatably mounted upon said frame and the drive shaft providing a pivot for said first end of said handle;

(b) a ratchet wheel fixedly mounted upon said drive shaft, and said sheave fixedly mounted upon said drive shaft;

(c) a second shaft fixedly attached to said handle;

(d) a drive pawl rotatably mounted upon said second shaft;

(e) a first spring fixedly attached at a first end to said handle and fixedly attached at a second end to said drive pawl so as to rotate a first end of said drive pawl against said ratchet wheel, causing said first end of said drive pawl to engage said ratchet during downward arcuate motion of said handle;

(f) means for disengaging said drive pawl from said ratchet wheel, whereby during arcuate motion in a downward direction of said handle said first end of said drive pawl will lock against said ratchet wheel and transmit force from said handle to said sheave by said drive shaft and cause said sheave to rotate and to wind up said drive cable and transmit said force to said means for splitting said log thereby applying compressive force upon said log and causing said log to split, and during arcuate motion in an upward direction of said handle said first end of said drive pawl will slidably move along said ratchet and be held in contact with said ratchet wheel by said first spring, and upon disengaging said drive pawl from said ratchet wheel then said drive cable may be unwound from said sheave.

8. A log splitter as claimed in claim 7, and a third shaft fixedly attached to said frame;

and a locking pawl rotatably mounted upon said third shaft which slidably engages said ratchet wheel and prevents said sheave to unwind said drive cable;

and a second spring which holds said locking pawl against said ratchet wheel;

and means to disengage said locking pawl so as to allow said sheave to unwind said drive cable.

9. A log splitter as claimed in claim 8, wherein said means to disengage said locking pawl is a foot pedal.

10. A log splitter as claimed in claim 8, wherein said means to disengage said locking pawl is a flexible linkage which causes said locking pawl to disengage when said handle is rotated into an extreme upward position.

11. A log splitter as claimed in claim 1, wherein said means for penetrating said log is a movable wedge; and said means for holding said log is a backstop; and a means for mechanically returning said movable wedge to a home position after said movable wedge has been driven into said log for the purpose of splitting said log, whereby said drive cable unwinds from said sheave as said movable wedge returns to said home position.

12. A log splitter as claimed in claim 11, wherein said means for mechanically returning said movable wedge to a home position comprises:

a return cable; and a third spring attached to a first end to said frame and attached at a second end to a first end of said return cable and a second end of said return cable attached to said movable wedge; and at least one pulley to guide said return cable and change the direction of said return cable, whereby said third spring is extended as said movable wedge is driven into said log by said drive cable and said return cable applies force to said movable wedge so as to pull said movable wedge out of said log and unwind said drive cable from said sheave and thereby return said movable wedge to said home position, and said third spring is prevented from moving said movable wedge into said home position by said locking pawl, and upon release of said drive pawl and said locking pawl from said ratchet wheel then said third spring is free to move said movable wedge into said home position.

13. A log splitter as claimed in claim 11, and a bumper made of resilient material to protect said movable wedge and said frame from damage by impact between said movable wedge and said frame when said movable wedge is returned to said home position by said third spring.

14. A log splitter as claimed in claim 11, wherein said means for mechanically returning said movable wedge to said home position comprises:

a compression spring which has a first end lodged against said frame and a second end lodged against said movable wedge so that said compression spring is compressed and thereby exerts force against said movable wedge as said movable wedge is driven into said log by said drive cable, whereby upon release of said locking pawl and said drive pawl then said movable wedge is driven by said compression spring toward said home position.

15. A log splitter as claimed in claim 1, wherein said frame comprises:

a front end plate;

a rear end plate;

a first elongate member; and a second elongate member wherein said elongate members are spaced apart and essentially parallel, and are both fixedly joined to a front end plate at a first end and a rear end plate at a second end, and providing a slot between said elongate members, said slot having essentially parallel sides running from said front end plate to said rear end plate, and said means for winding a second end of said drive cable onto said sheave mounted at said second end of said elongate members, and said slot providing a track along which said means for penetrating said log is driven toward said second end by winding said drive cable onto said sheave, and said log to be split being placed upon said slot so that it may be penetrated by said means for penetrating said log as said means for penetrating is driven toward said second end.

16. A log splitter as claimed in claim 15, wherein said means for penetrating said log comprises:

a carriage; and a first axle fixedly attached to said carriage and mounted essentially perpendicular to said slot; and a first set of carriage wheels rotatably mounted upon said first axle and rolling upon a first upper surface of said elongate members; and a second axle fixedly attached to said carriage and mounted essentially perpendicular to said slot; and a second set of carriage wheels rotatably mounted upon said second axle and rolling upon a second under surface of said elongate members; and a wedge mounted fixedly upon said carriage so that the wedge extends beyond said first upper surface of said elongate members and has an edge directed toward said second end of said elongate members, and said carriage has attached to a first end said drive cable and said attachment is made to a point beneath said first upper surface of said elongate members, whereby when tension is applied to said drive cable by winding said drive cable onto said sheave, said first set of carriage wheels bears down upon said first upper surface of said elongate members and said second set of carriage wheels bears up upon said second under suface of said elongate members, and said edge of said wedge bears against an end of said log to be split, and increased tension in said drive cable causes said carriage to move toward the second end of said elongate members as said edge of said wedge penetrates said log, splitting said log.

17. A log splitter as claimed in claim 1, wherein said means for penetrating said log is a cone, the apex of which bears against said log, and penetrates said log, splitting said log when driven against said log by winding said cable upon said sheave.

18. A log splitter as claimed in claim 1, wherein said means for penetrating said log is fixedly mounted to said frame; and said means for holding said log against the force exerted upon said log by said means for penetrating said log is movable, and is driven toward said fixedly mounted means for penetrating said log as said drive cable is wound upon said sheave, thereby moving said log against said means for penetrating said log and causing said log to be penetrated and split.

* * * * *

UNITED STATES PATENT AND TRADEMARK OFFICE

CERTIFICATE OF CORRECTION

PATENT NO. : 4,378,825

DATED : April 4, 1983

INVENTOR(S) : Edward M. Schroeder

Figure 13:
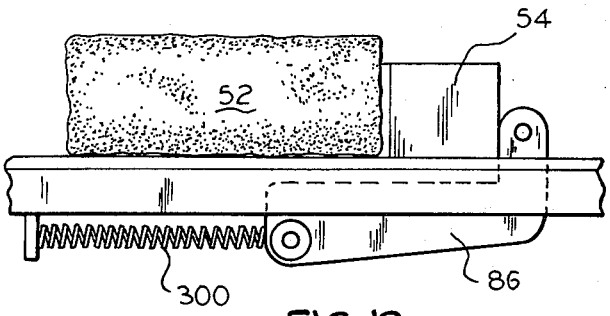
FIG. 13 is a side view of the carriage.

It is certified that error appears in the above-identified patent and that said Letters Patent are hereby corrected as shown below:

Col. 6, line 4, "FIG. 14" should read --FIG. 13--.

Col. 6, line 46, after "between" and before "means" insert --said--.

Signed and Sealed this

*Thirty-first* Day of *May 1983*

[SEAL]

*Attest:*

DONALD J. QUIGG

*Attesting Officer*

*Acting Commissioner of Patents and Trademarks*